United States Patent [19]

Mario et al.

[11] Patent Number: 4,881,347

[45] Date of Patent: Nov. 21, 1989

[54] SKI REPAIRING MACHINE

[76] Inventors: Petrin Mario, 548 15 Ave., LaSalle, Quebec, Canada, H8P 2R9; Petrin Blaise, 4470 Lafontaine, Montreal, Quebec, Canada, H1V 1P3

[21] Appl. No.: 148,946

[22] Filed: Jan. 27, 1988

[51] Int. Cl.[4] ..... B24B 7/00

[52] U.S. Cl. ..... 51/5 R; 51/5 D; 51/92 R; 51/165.77

[58] Field of Search ..... 51/92 R, 165.77, 165.9, 51/217 R, 217 A, 266, 5 R, 5 D, 166 MH; 125/2, 11 H, 11 NT

[56] References Cited

U.S. PATENT DOCUMENTS

| | | | |
|---|---|---|---|
| 757,763 | 4/1904 | McCanoe . | |
| 3,339,317 | 9/1967 | Cleland | 51/92 R |
| 3,667,166 | 6/1972 | White | 51/92 R |
| 3,719,008 | 3/1973 | Hayers . | |
| 4,018,007 | 4/1977 | Oshini | 51/47 |
| 4,085,547 | 4/1978 | Lawson . | |
| 4,089,076 | 5/1978 | Sparling . | |
| 4,577,586 | 3/1986 | Morris et al. | 118/63 |
| 4,648,210 | 3/1987 | Reinmold et al. | 51/165.77 |

OTHER PUBLICATIONS

Technology and Tools, 1986, p. 79.
1986 Technology and Tools, p. 79, Automatic Scraper.
1986, Technology and Tools, pp. 84–89, Electronic Wet Belt Sauder and Stone Grinder.
1986 Technology and Tools, p. 90, Skid Electronic.
1986, Technology and Tools, p. 91, Skid Combi.
Wintersteiger catalog, BAV, Base Scraper.
Wintersteiger Catalog, /et 280, Bench Grinding Machine.
Wintersteiger catalog, KNS, Side Edge Grinding Machine.
Wintersteiger catalog, Sel 150, Auto Feed Belt Sauder.
Wintersteiger catalog, Mcr 1500/800, Electronically Controlled Stone Drum Grinding Machine.
Wintersteiger catalog, Afg 440, Automatic Edge Sharpener.

*Primary Examiner*—Frederick R. Schmidt
*Assistant Examiner*—Maurina Rachuba
*Attorney, Agent, or Firm*—Larson and Taylor

[57] ABSTRACT

An apparatus for grinding the base of an alpine ski, comprising a frame, a reciprocating carriage mounted on the frame and being adapted to receive a ski, a base grinding tool mounted to the frame for engagement with the base of the ski, the movement of the carriage causing engagement between the grinding tool and the ski base in successive grinding strokes. The machine also comprises a pressure control device in operative relation to the grinding tool for maintaining the grinding pressure on the base generally constant during a grinding stroke.

18 Claims, 6 Drawing Sheets

SKI REPAIRING MACHINE

FIELD OF THE INVENTION

The present invention relates in general to ski servicing equipment and more particularly to an apparatus for grinding the base of a ski.

BACKGROUND OF THE INVENTION

A modern alpine ski comprises a core of synthetic material wrapped or sandwiched between various layers of fibrous synthetic material such as glass fibers, graphite, kevlar or the like, impregnated with a suitable resin. To provide good gliding characteristics, a base of plastic material which comes in direct contact with the snow is used because of its low coefficient of friction. To facilitate steering maneuvers, hard metallic edges are mounted on each side of the plastic base for biting into hard icy surfaces.

When the ski is used on rough terrain, stones or similar hard objects may contact and scratch the base. The damages must be repaired quickly because if water is allowed to enter the ski through the scratches on the base, delamination of the base may result.

A current technique for repairing the base of an alpine ski consists of filling the scratches on the base with molten plastic material and when the plastic material has hardened, the base is sanded to obtain an even surface. The sanding operation is performed with a wet belt-type sanding machine on which the operator passes the ski, the base being in contact with the sanding belt. This operation is difficult to perform because the speed at which the ski is passed on the sanding belt as well as the pressure applied on the ski must be kept constant, requiring great skill and experience.

OBJECTS AND STATEMENT OF THE INVENTION

An object of the present invention is a machine for grinding the base of an alpine ski which is generally superior to prior designs.

Another object of the invention is a machine for grinding the base of an alpine ski allowing precise control of the grinding pressure.

Another object of the invention is a machine for grinding the base of an alpine ski allowing precise control of the relative speed between the grinding tool and the ski base.

A further object of the invention is a machine for grinding the base of a ski which is automatic in operation.

The foregoing objects of the invention are achieved by providing a machine for grinding the base of a ski, the machine comprising a movable carriage mounted on a suitable supporting structure and designed to receive a ski, the base of the ski facing upwardly. A grinding tool, mounted to the supporting structure comes in contact with the ski base to remove the excess of plastic material used for filling the scratches and for providing an even surface. An important feature of the invention resided in the The movable carriage is driven by a suitable mechanism and undergoes a reciprocating motion, at each stroke the grinding tool engaging the ski base.

The ski is mounted to the movable carriage by means of two clamps which can pivot on the carriage within narrow limits about the longitudinal axis of the ski. Keeping in mind that a ski may be slightly warped about its longitudinal axis, the purpose of this arrangement is to allow the ski base to stay parallel to the grinding tool during the entire grinding stroke. For more specific applications, where tilting of the ski is not desired, the clamps may be fixed into a desired angular position with respect to the carriage.

The grinding tool comprises, in a preferred embodiment, a rotary grindstone driven by an electric motor. The grindstone is slightly wider than the ski base for grinding the entire base during a grinding stroke.

To prevent the buildup of small plastic and metallic particles on the working surface of the grindstone, a lubricating fluid injection system is used, of the same type employed in conjunction with machine tools. The fluid is continuously injected on the grindstone during the operation thereof to carry away particles removed from the ski base.

The grinding mechanism is mounted on an arm having one end pivotally mounted to the supporting structure of the machine, the opposite end of the arm being supported by the piston rod of a pneumatic piston-cylinder assembly (hereinafter "cylinder"), the grinding mechanism being located at midpoint between the arm's ends. By keeping the pressure in the pneumatic cylinder constant, the arm can move slightly up and down to enable the grinding mechanism to follow the contour of the ski, and at the same time the pressure exerted on the ski by the grindstone remains generally constant.

The machine, according to the present invention, is also equipped with a scraping device to remove the plastic material in excess used to fill scratches on the base before the grinding operation is performed. The scraper is mounted to the arm supporting the grinding mechanism and is lowered in operative position on the ski base by a pneumatic cylinder. The scraping pressure is controlled by adjusting the air pressure in the pneumatic cylinder. By keeping the air pressure constant, the scraping pressure also remains constant.

Therefore, the present invention comprises in a general aspect, an apparatus for grinding the base of a ski, the apparatus comprising:

a frame a carriage adapted to receive a ski, the carriage being mounted on the frame and being movable in a reciprocating manner with respect to the frame;

a base grinding tool mounted to the frame for engagement with the base of the ski, movement of the carriage causing engagement between the grinding tool and the ski base in successive grinding strokes; and a pressure control means operatively connected to the grinding tool for keeping the pressure exerted by the grinding tool on the base generally constant during a grinding stroke.

DESCRIPTION OF A PREFERRED EMBODIMENT

(A) GENERAL DESCRIPTION OF THE MACHINE

Figure 1:
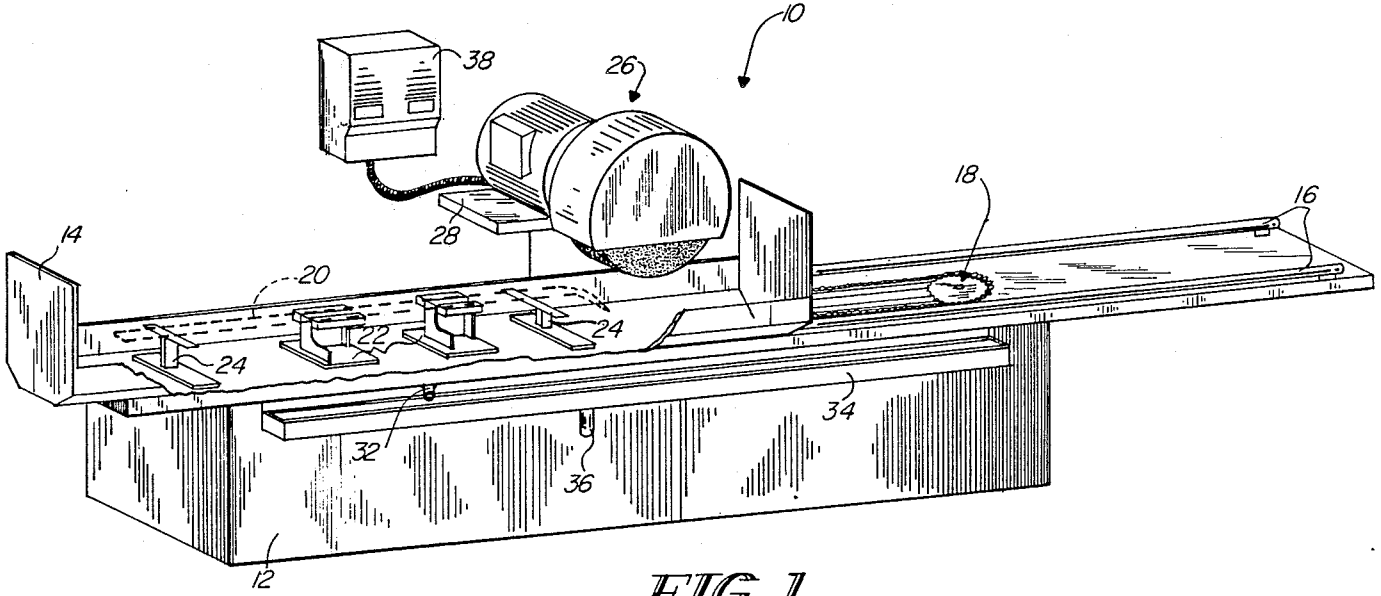
FIG. 1 is a perspective view of a machine for grinding the base of a ski, according to the present invention, some elements of the machine being omitted.

FIG. 1 of the annexed drawings illustrates a machine 10 used for grinding the base of an alpine ski. The machine 10 comprises a supporting structure 12 made of sheet-metal or any other appropriate material, on which is mounted a movable carriage 14. The carriage 14 is supported on a pair of parallel guide rods 16 secured on top of the supporting structure 12 and extending along its longitudinal axis. The guide rods 16 are engaged in linear bearings (not shown in the drawings) mounted to the underside of the carriage 14, thus, allowing the carriage to slide back and forth on the guide rods 16.

A driving mechanism, identified generally at 18, operating with a chain and sprockets is employed to impart a reciprocating motion to the carriage 14.

The carriage 14 has an elongated shape comprising a bottom wall, two short and upwardly extending longitudinal side walls and two end walls which project beyond the side walls. The carriage 14 is made of sheet-metal, the various elements being assembled by welding. It is plain, however, that other methods of construction may be envisaged without departing from the spirit of the invention.

The carriage 14 is adapted to receive a ski, shown in dotted lines at 20, the base of the ski facing up. The ski 20 is securely held on the carriage by two clamps 22. Two additional T-shaped supports 24 are also provided for supporting the extremities of the ski 20. Each T-shaped support 24 comprises a vertical arm secured to the bottom wall of the carriage 14, and a horizontal arm pivotally mounted to the upper end of the vertical arm so that it can tilt about the longitudinal axis of the ski 20.

Figure 3:
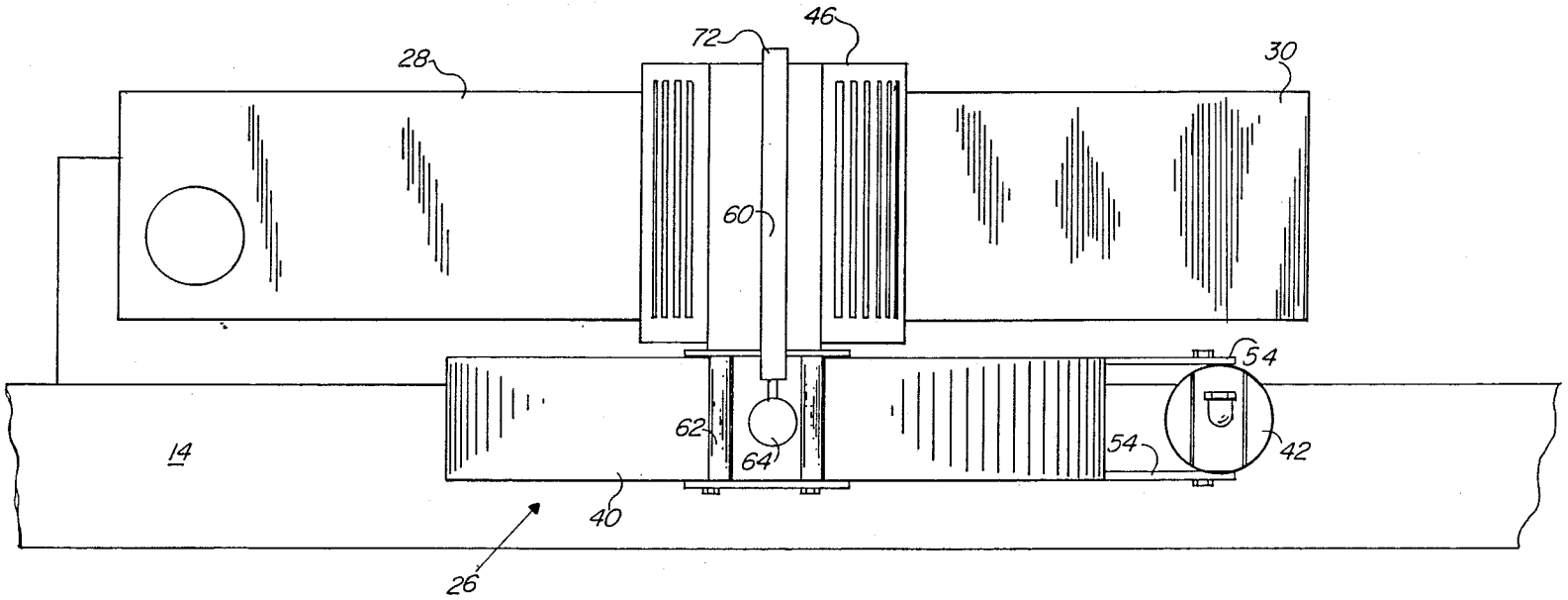
FIG. 3 is a top view of the grinding tool illustrated in FIG. 2.

To effect the grinding of the ski base, the machine 10 is equipped with a grinding tool 26 which is mounted on an arm 28 of metallic construction. The arm 28 is connected to the supporting structure 12, as best shown in FIG. 3 by means of a pivotal connection 30, the opposite end of the arm 28 remaining free to move up and down.

The machine 10 also comprises a fluid injection system for continuously supplying lubricating fluid on the working face of the grinding tool, of the same type used in conjunction with machine tools, to prevent overheating of the ski base and to carry away particles removed from the ski base. The fluid is supplied to the grinding tool 26 by a pumping system, to be described later, and it flows in the movable carriage 14. The lubricating fluid is drained from the carriage 14 through a short spout 32 discharging fluid into a collection pan 34, slightly longer than a stroke of the carriage 14. The fluid collection pan 34 is secured in front of the supporting structure 12 and it is provided with a discharge spout 36 leading to a fluid recirculating pump (not shown in the drawings).

The machine 10 is also provided with a control panel 38 on which are located various switches and indicators to enable the operator to adjust the speed of rotation of the grinding tool, the speed of the carriage 14 and the grinding pressure.

The machine 10 is operated by a plurality of pneumatic cylinders which will be described in detail hereinafter. The valving system used to control the air flow from a suitable compressor to these cylinders will not be described because such system is well known to those skilled in the art.

The various elements of the machine 10 will now be described in detail.

(B) THE GRINDING TOOL

Figure 2:
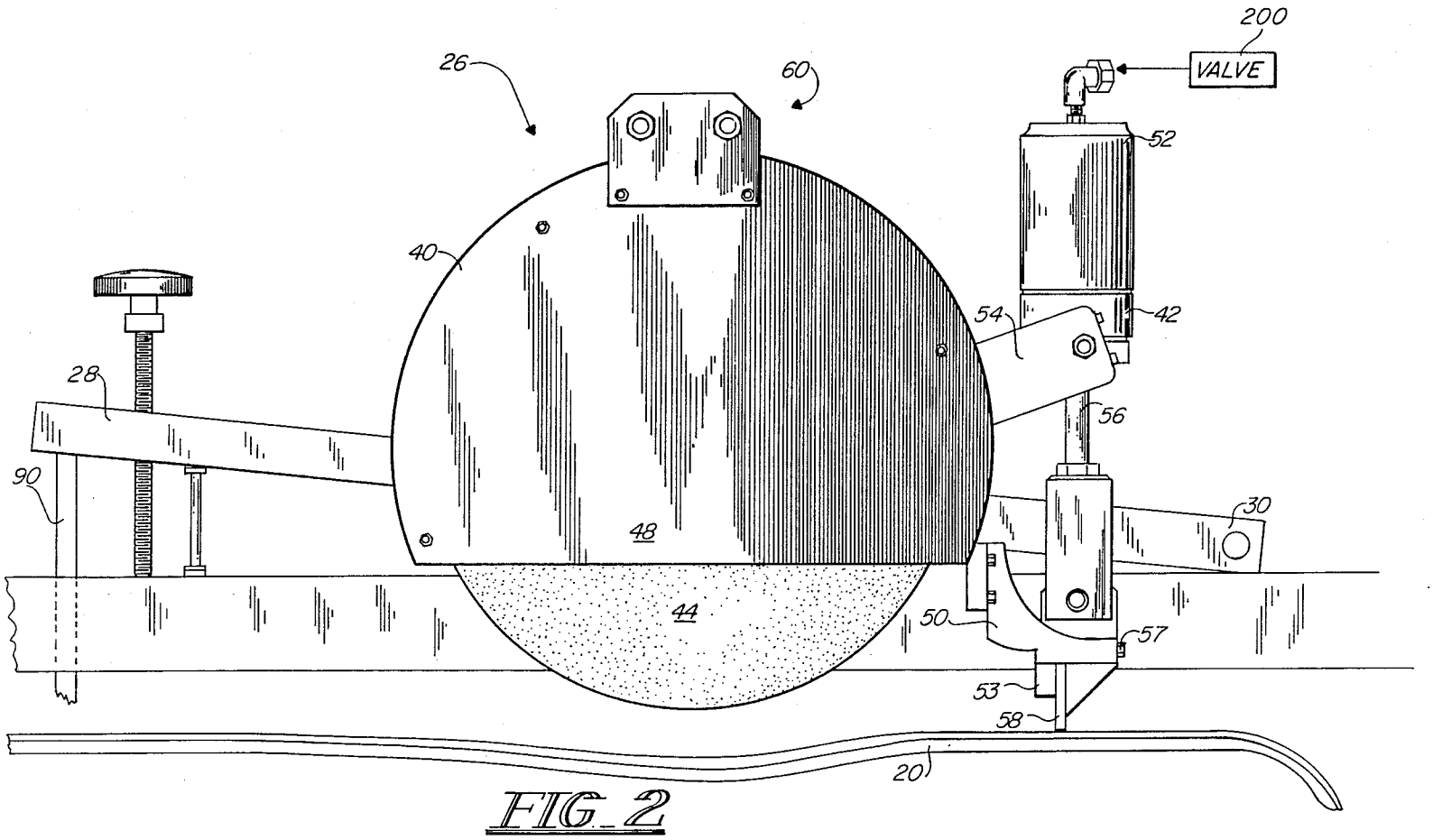
FIG. 2 is an elevational schematical view of the grinding tool of the machine shown in FIG. 1.
Figure 4:
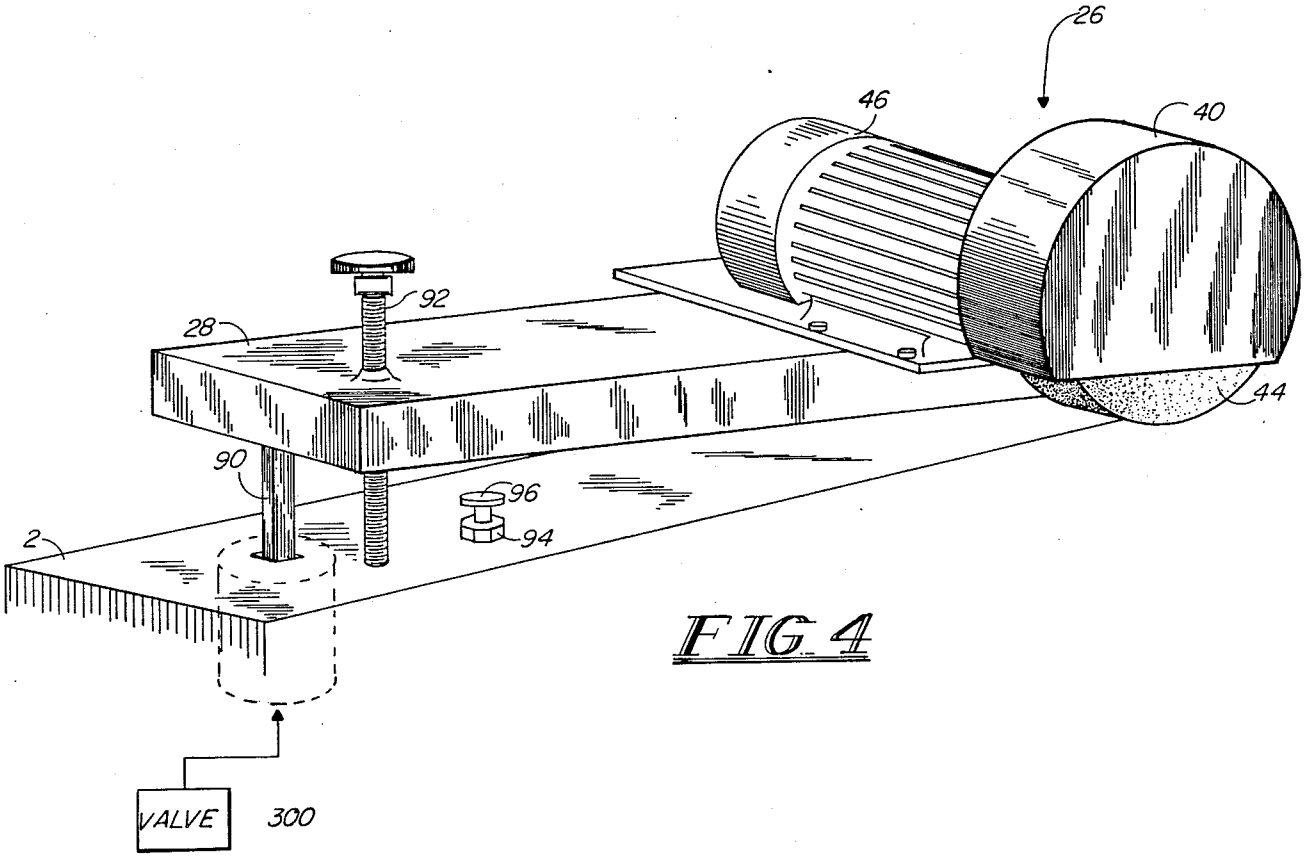
FIG. 4 is a perspective view of the grinding mechanism of the machine shown in FIG. 1.

The grinding tool 26 is best shown in FIGS. 2, 3 and 4. The grinding tool 26 comprises a grinding mechanism 40 to which is mounted a scraper 42, both being mounted to the arm 28. More particularly, the grinding mechanism comprises a large grindstone 44 driven by an electric motor 46, the power rating of the motor 46 being selected according to the size of the grindstone 44 whose thickness should be at least equal or greater than the width of the ski 20 to permit grinding of the entire ski base in a grinding stroke.

The grindstone 44 is partially enclosed into a metallic housing 48, only the lower portion of the grinstone 44 projecting from the housing 48 to engage the ski base.

On the housing 48 is mounted a scraping device including a scraping block 50 pivotally mounted to the lower end of the housing 48, the scraping block 50 being actuated by a pneumatic cylinder 52 pivotally mounted on the housing 48 by two brackets 54 (only one is shown in FIG. 2). The pneumatic cylinder comprises a piston rod 56 pivotally connected to the scraping block 50 for raising, lowering and controlling the scraping pressure exerted on the ski 20.

The lower portion of the scraping block 50 defines a blade holder including a pressure plate 53 held in place by bolts 57 which clamps a blade 58 of standard construction. The blade 58 is an elongated rectangular plate made of wear-resistant metal having two main faces and four smaller side-walls which are perpendicular to the main faces, thus defining four scraping edges extending along the longitudinal axis of the plate. When one of the scraping edges is worn-out, the bolts 57 are unscrewed to remove the pressure plate 54 for installing the blade 58 in a different position so that a new scraping edge is set in position. When all four scraping edges of the plate are used-up, the plate is discarded and a new one is installed.

For optimum results, the blade 58 extends approximately 5 degrees with respect to the longitudinal axis of the ski and it is slightly tilted rearwardly (tilted to the left in FIG. 2).

Figure 5:
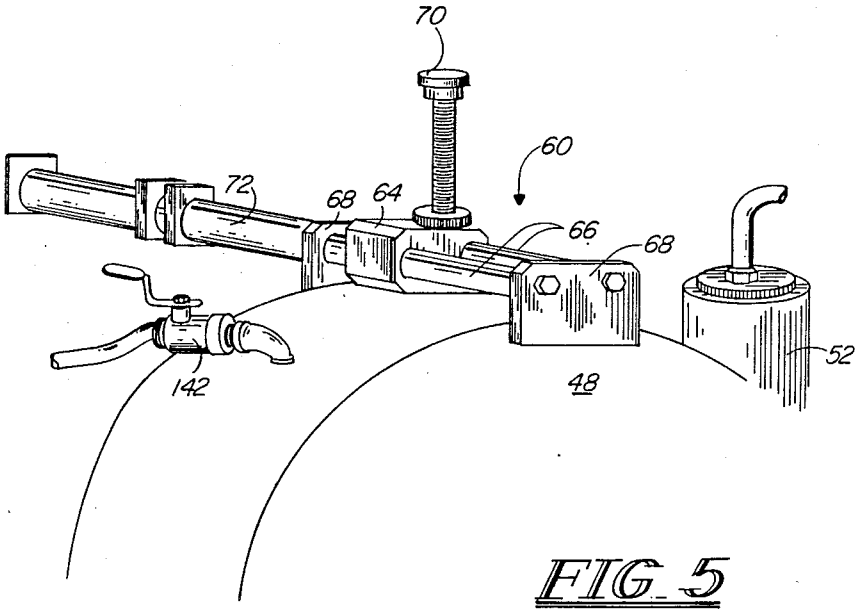
FIG. 5 is an enlarged perspective view of a sharpener for the grinding tool.
Figure 10:
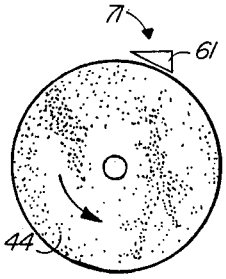
FIG. 10 is a schematical view illustrating the position of the sharpening diamond with respect to the grindstone.

The grinding tool is also provided with an automatic diamond sharpener 60 to ensure that the grindstone 44 is sharp and runs true. The sharpener 60, best illustrated in FIGS. 3, 5 and 10 is mounted on the housing 48 of the grindstone, adjacent to the brackets 54 and comprises a one carat diamond 61 projecting in the housing 48 through an axial slot 62 and engaging the working surface of the grindstone 44. The diamond 61 is fixed to a diamond carrier 64 slidingly mounted on a pair of parallel guide rods 66 secured to two end plates 68 mounted on the housing 48. The carrier 64 is also provided with a depth adjustment mechanism 70 in the form of set screw for adjusting the depth of penetration of the diamond in the housing 48 to compensate for wear of the diamond and of the grindstone 44. Referring to FIG. 10, the diamond 61 is triangular in cross-section and engages the grindstone with one of its faces. Manipulation of the depth adjustment mechanism 70 results in rotating the diamond 61 in the direction shown by arrow 71.

Figure 9:
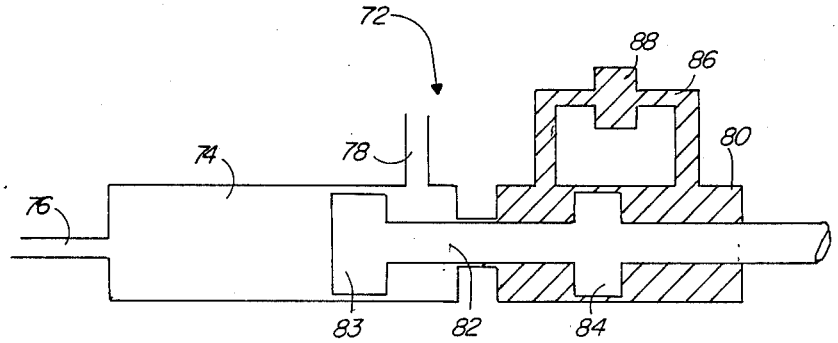
FIG. 9 is a schematical view of a hydro-pneumatic mechanism for driving the grinding tool sharpener.

The sharpener 60 also comprises a hydro-pneumatic actuating device 72 for moving the diamond across the grindstone 44. Referring briefly to FIG. 9, the hydro-pneumatic device 72 includes a pneumatic cylinder 74 connected by means of lines 76 and 78 to a source of compressed air through appropriate valving. Adjacent the pneumatic cylinder 74 is mounted a hydraulic cylinder 80. A piston rod 82 extends in both cylinders 74 and 80 and comprises a first piston 83 mounted in the pneumatic cylinder 74, a second piston 84 mounted in the hydraulic cylinder 80 and an end rod projecting through the hydraulic cylinder 80 and being in driving connection to the diamond carrier 64.

The hydraulic cylinder 80 is filled with oil and it comprises a recirculating fluid line for conveying fluid from one end of the cylinder 80 to the other end thereof through a flow rate adjusting valve 88.

The operation of the hydro-pneumatic actuating device 72 is as follows. To drive the diamond across the surface of the grindstone, compressed air is injected through the line 76, the line 78 being open. The piston rod 83 extends out of the pneumatic cylinder 74, and the piston 84 forces the oil in the hydraulic cylinder 80 to flow in the recirculating line 86 through the valve 88. By setting the valve 88 to a desired flow-rate value, the advancement of the piston 84 and, thus, the advancement of the diamond carrier 64 may be very precisely controlled.

To retract the piston rod 82, compressed air is injected through the line 78, the line 76 being left open.

Referring now to FIGS. 2 and 4, the arm 28 supporting the grinding mechanism 40 is supported at the end opposite the pivotal connection 30 by a pneumatic cylinder (not shown in the drawings) whose piston rod is identified by the numeral 90.

The arm 28 is also provided with an elongated rod 92 threadedly engaged in the arm 28 and when the piston rod 90 is retracted, the end of the rod 92 abuts on the supporting structure 12. By screwing or unscrewing the rod 92, the position of the arm 28 with respect to the supporting structure 12 may be adjusted.

The machine 10 also comprises a pneumatic cylinder 94 mounted under the arm 28. When the piston rod 96 of the cylinder 94 is extended, the arm 28 is brought to its uppermost position.

(C) THE SKI CLAMPING DEVICE

Figure 6:
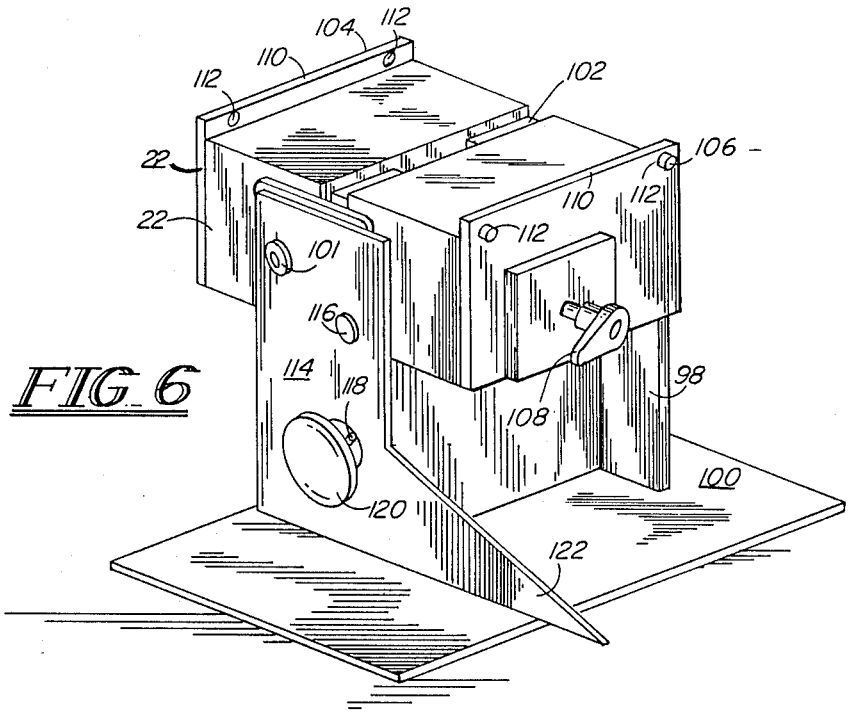
FIG. 6 is an enlarged perspective view of a clamping device for mounting a ski on the machine, according to the present invention.

When a ski 20 is to be installed in the movable carriage 14, it is clamped in place by using two clamps 22, one of the clamps being shown in detail in FIG. 6. The clamp 22 comprises a support made of a short section of an I-beam 98 whose lower end is welded to a rectangular horizontal plate 100 bolted to the bottom wall of the movable carriage 14. To the upper end of the I-beam 98 is pivotally mounted a clamping block 102 by means of a pivot pin 101, comprising two jaws 104 and 106 which can be brought toward and away from each other by rotating a handle 108. Each jaw can slightly pivot about a vertical axis and comprises a raised portion 110 for engaging the side walls of the ski 20. For certain types of skis whose side walls are not strictly perpendicular to the base thereof, projecting pins 112 are provided on the raised portions 110 to securely engage the ski.

An L-shaped bracket 114 is mounted to the pivot pin 101 and it is also secured by means of a screw 116 to the clamping block 102 for moving in unison therewith about pivot pin 101. The L-shaped bracket 114 comprises at its lower end a slot 118 through which extends a screw threadedly engaged in the I-beam 98. The free end of the screw is provided with a handle 120 to permit manual tightening or untightening of the screw.

The L-shaped bracket 114 further comprises a pointer 122 facing a graduated scale indicating the inclination of the clamping block 102 in degrees.

(D) THE CARRIAGE DRIVING MECHANISM

Figure 7:
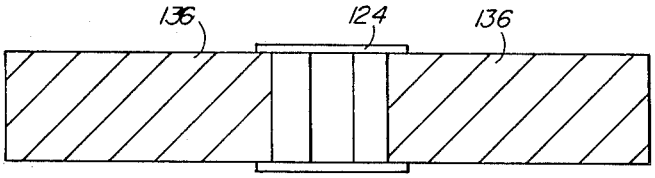
FIG. 7 is a schematical cross-sectional view taken along lines 7—7 in FIG. 1.
Figure 8:
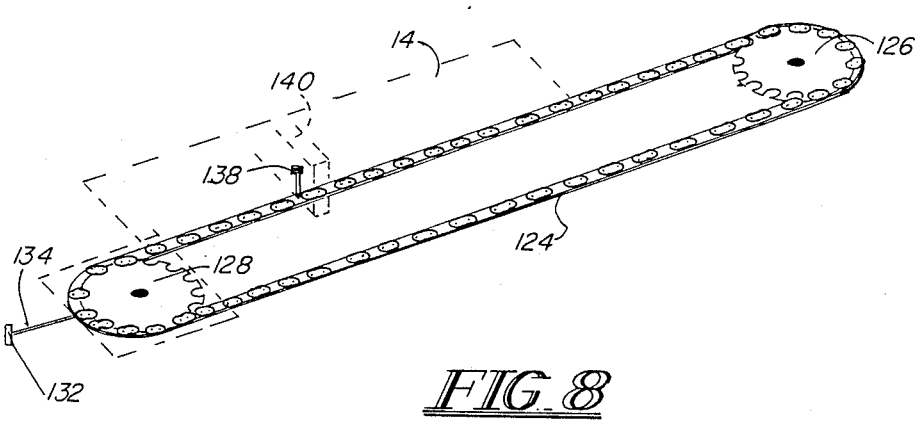
FIG. 8 is a schematical view illustrating the mechanism for driving the carriage of the machine, according to the invention.

Referring to FIGS. 7 and 8, the carriage driving mechanism 18 comprises a chain 124 extending between the guide rods 16, the chain 124 being mounted on driving sprocket 126 and idler sprocket 128. Driving sprocket 126 is connected through suitable gears to an electric motor mounted under the supporting structure 12. The gear ratios as well as the power rating of the motor used for driving the sprocket 126 are selected according to the speed and the weight of the carriage 14.

The idler sprocket 128 is mounted on a plate 130 movable on the supporting structure 12 by means of a nut 132 engaging a threaded rod 134 mounted to the plate 130. Turning the nut 132 results in pulling the idler sprocket 126 away from the driving sprocket 126 to tighten the chain 124.

The chain 124 runs between stainless steel guides 136 mounted on either side of the chain 124, as best shown in FIG. 7.

As it is well known to those skilled in the art, a chain link has top and bottom portions slightly wider than the central portion thereof. To effectively support the chain 124, the guides 136 are slightly shorter than a chain link wherein the top and bottom portions of the chain link run on the top and the bottom surfaces of the guides 136, respectively. Furthermore, the guides 136 are spaced less than the maximum lateral dimension of the chain links so that the chain cannot move vertically.

On the chain is mounted an upwardly projecting pin 138 engaged in a laterally extending U-shaped seat 140 formed on the underside of the movable carriage 14.

When the driving sprocket 126 is set in motion, the pin 138 drives the carriage 14 through engagement with the U-shaped seat 140. When the pin 138 reaches the sprocket 126 or the sprocket 128, it moves laterally in the U-shaped seat 140 and when it passes the sprocket it drives the carriage 14 into an opposite direction. Thus, when the pin travels from one sprocket to the other, the carriage 14 reciprocates on the guide rods 16.

By varying the speed of the electric motor driving the carriage, the speed of the carriage can be adjusted as desired.

(E) LUBRICATING FLUID PUMPING AND CIRCULATING SYSTEM

The machine 10 is equipped with a lubricating fluid tank (not shown in the drawings) located under the supporting structure 12. A small electric pump draws fluid from the tank and discharges the fluid through a pipe fitting 142 in the housing 48 of the grindstone 44, as best shown in FIG. 5. From the grinding mechanism 40, the fluid is discharged in the movable carriage 14 where it drained through the spout 32 in the fluid collecting pan 34. The bottom wall of the fluid collecting pan 34 is provided with a felt-like material to filter the lubricating fluid and retain material grinded from the base of the ski 20. Then, the lubricating fluid returns to the tank through the spout 36.

The lubricating fluid used is of a type which is commercially available.

(F) OPERATION OF THE MACHINE

Assuming that the scratches on the base of the ski 20 have been previously filled with plastic material, the base of the ski 20 is now ready to be grinded on the machine 10.

To mount the ski 20 in the movable carriage 14, the handles 108 of the clamping devices 22 are rotated to fully open the jaws thereof, then, the ski is mounted on the clamping devices 22, the base facing upward. The handles 108 are tightened to clamp firmly the ski 20 and the handles 120 on the L-shaped brackets 114 are untightened to ensure that the ski 20 can slightly tilt about its longitudinal axis.

The electric motor 46 is started to set in motion the grindstone 44. Simultaneously, the lubricating fluid pump is actuated to circulate fluid on the grindstone 44.

Before beginning the grinding operation, it is preferable to sharpen the grindstone 44. At this end, the hydro-pneumatic mechanism 72 is actuated to drive the diamond carrier 64 and the sharpening diamond 61 across the working surface of the grindstone 44. When the grindstone has been sharpened as required, the diamond carrier 64 is returned to its rest position by operating the hydro-pneumatic mechanism 72.

The pneumatic cylinder 94, under the arm 28, is actuated to extend the piston rod 96, raising the arm 28 to its uppermost position. The pneumatic cylinder 52 of the scraping device 42 is actuated to extend the piston rod and lower the scraper in operative position. The movable carriage 14 is set in motion and the blade 58 of the scraping device 42 passes on the base of the ski 20 and removes any plastic material extending beyond the edges of the ski 20. The pressure on the scraper 42 is controlled by adjusting the air pressure in the cylinder 52, the higher the pressure in the cylinder 52 the greater the force exerted by the blade 58 on the ski base. During a scraping stroke the pressure is kept constant in the cylinder 52 so that the scraping pressure remains constant. The pressure control is achieved by a pressure control valve of a type well known to those skilled in the art, illustrated schematically at 200 in FIG. 2.

When the scraper 42 passes on the base of the ski 20, it will follow the contour of the ski which is slightly concave in the central region. To avoid a reduction in the scraping pressure resulting from the extension of the piston rod 56 and the resulting increase of volume in the cylinder 52 when the scraper 42 reaches the central region, the control valve will admit more compressed air in the cylinder 52 to compensate. On the other hand, when the scraper reaches the end region of the ski, the piston rod 56 is pushed up, increasing the pressure in the cylinder 52. The control valve will then allow air to escape the cylinder 52 to bring the pressure therein to the preset value.

For most applications, one scraping stroke will be necessary to remove any plastic material in excess on the base. If more scraping is required, the movable carriage is simply kept in motion longer.

When the scraping process has been completed, the piston rod 56 of the pneumatic cylinder 52 is retracted to raise the scraping block 50 to the inoperative position. Then, the piston rod 96 of the pneumatic cylinder 94 is retracted to lower the arm 28. The piston rod 90 is then extended, the pressure applied on the piston rod 90 being used to control the pressure exerted by the grindstone 44. As the pressure exerted by the piston rod 90 increases, the pressure exerted by the grindstone on the ski base diminishes accordingly. Such an arrangement allows to obtain a quasi-constant pressure exerted by the grindstone 44 regardless of the position of the arm 28 within, a certain range of angular displacement of the arm, if the pressure exerted by the piston rod 90 remains constant. Thus, the grindstone 44 is capable of following the contour of the ski while exerting a generally constant pressure.

The pressure control on the piston rod 90 is effected by using a commercially available valve of a type known in the art, shown schematically at 300 in FIG. 4 which admits compressed air or permits compressed air to escape for keeping the pressure on the piston rod 90 constant, in a manner similar to the air pressure control effected in the pneumatic cylinder 52, as described above.

To effect the grinding of the ski base, the movable carriage 14 is set in motion and the pressure on the piston rod 90 is selected as desired, the number of grinding strokes depending on the desired degree of polishing of the base.

If desired to chamfer the edges of the ski 20, the clamping devices 22 are blocked in the desired angular, by tightening the handles 120, the angular position being indicated to the operator by the pointer of the bracket 114. When one of the edges is chamfered, the ski is tilted in the opposite direction and blocked in this position to chamfer the other edge.

The speed of the movable carriage, the speed of rotation of the grindstone, the grinding pressure and the scraping pressure can be varied in order to fine tune the ski base, different combinations of grinding pressure, scraping pressure, grindstone speed and carriage speed producing different finishes on the base. By appropriately selecting these parameters a precise tuning of the ski may be obtained for specific snow conditions.

Although the invention has been described above with respect to one specific form, it will be evident to persons skilled in the art that it may be refined and modified in various ways. It is therefore wished to have it understood that the present invention should not be limited in interpretation except by the terms of the following claims.

We claim:

1. An apparatus for grinding the base of a ski, said base having a given contour, said apparatus comprising:
   - a frame;
   - a carriage for receiving said ski, said carriage being mounted to said frame for movement thereabout,
   - means for supplying motive power in driving relationship with said carriage to impart a reciprocating movement to said carriage;
   - a grinding tool mounted for movement to said frame, reciprocating movement of said carriage causing said grinding tool to engage said base in successive grinding strokes, during a grinding stroke said grinding tool moving with respect to said frame to follow the contour of said base;

pressure control means coupled to said grinding tool for maintaining the grinding pressure thereof generally constant at various positions of said grinding tool with respect to said frame, thus allowing said grinding tool to exert a generally constant grinding pressure on said base while following the contour thereof;

and further comprising a scraper means mounted to the frame for movement relative to said frame between an inoperative position and an operative position, wherein in said operative position said scraper means engages said base.

2. An apparatus as defined in claim 1, wherein said grinding tool comprises a rotary grindstone.

3. An apparatus as defined in claim 2, further comprising a diamond sharpener for said rotary grindstone.

4. An apparatus as defined in claim 1, further comprising a ski clamping means pivotally mounted to said carriage, thus allowing a ski received in said ski clamping means to be tilted about a longitudinal axis of said ski.

5. An apparatus as defined in claim 4, said ski clamping means comprising means for blocking said ski clamping means in a desired angular position.

6. An apparatus as defined in claim 1, further comprising a scraper driving means mounted to said frame, said a driving sprocket mounted to said frame, said driving sprocket being in operative relationship with said means for supplying motive power;

an idler sprocket mounted to said frame, said idler sprocket being spaced apart from said driving sprocket;

an elongated recess formed on a wall of said carriage, said recess extending transversely to the direction of movement of said carriage;

a chain in engagement with said driving and idler sprockets; and a projecting pin mounted to said chain, said projecting pin being received in said recess.

7. An apparatus as defined in claim 6, wherein said scraper driving means comprises a piston-cylinder assembly coupled to a source of fluid under pressure.

8. An apparatus as defined in claim 7, further comprising valve means coupled to said piston-cylinder assembly, said valve means maintaining a generally constant fluid pressure in said piston-cylinder assembly while said scraper means engages said base.

9. An apparatus as defined in claim 8, wherein said fluid is air.

10. An apparatus as defined in claim 1, further comprising an arm pivotally mounted to said frame, said grinding tool being mounted to said arm, said pressure control means including a piston-cylinder assembly coupled to said arm, said piston-cylinder assembly being coupled to a source of fluid under pressure.

11. An apparatus as defined in claim 10, wherein said pressure control means further comprises valve means coupled to said piston-cylinder assembly for maintaining fluid pressure in said piston-cylinder assembly generally constant while said grinding tool engages said base.

12. An apparatus as defined in claim 1, said apparatus further comprising a pair of guide rods mounted to said frame, said carriage being slidingly mounted on said guide rods.

13. An apparatus as defined in claim 12, further comprising:

a driving sprocket mounted to said frame, said driving sprocket being in operative relationship with said means for supplying motive power;

an idler sprocket mounted to said frame, said idler sprocket being spaced apart from said driving sprocket;

an elongated recess formed on a wall of said carriage, said recess extending transversely to the direction of movement of said carriage;

a chain in engagement with said driving and idler sprockets; and a projecting pin mounted to said chain, said projecting pin being received in said recess.

14. An apparatus for grinding the base of a ski, said base having a given contour, said apparatus comprising:

a frame;

a carriage for receiving said ski, said carriage being mounted to said frame for movement thereabout;

means for supplying motive power in driving relationship with said carriage to impart a reciprocating movement to said carriage;

a grinding tool mounted to said frame, reciprocating movement of said carriage causing said grinding tool to engage said base in successive grinding strokes;

pressure control means in operative relation with said grinding tool for maintaining the pressure exerted by said grinding tool on said base generally constant during a grinding stroke; and scraper means mounted to said frame for movement between an operative and an inoperative position, in said operative position said scraper means engaging said base.

15. An apparatus as defined in claim 14, further comprising an arm pivotally mounted to said frame, said grinding tool and said scraper means being mounted to said arm.

16. An apparatus as defined in claim 15, wherein said scraper means comprises a piston-cylinder assembly mounted to said arm, said piston-cylinder assembly being coupled to a source of fluid under pressure, said scraper means further comprising a scraper blade coupled to said piston-cylinder assembly.

17. An apparatus as defined in claim 15, said pressure control means including a piston-cylinder assembly coupled to said arm, said piston-cylinder assembly being coupled to a source of fluid under pressure.

18. An apparatus as defined in claim 14, further comprising a pair of guide rods mounted to said frame, said carriage slidingly engaging said guide rods.

* * * * *